US011215004B2

(12) United States Patent
Molnar

(10) Patent No.: US 11,215,004 B2
(45) Date of Patent: Jan. 4, 2022

(54) CLOSED LOOP DOOR POSITION CONTROL

(71) Applicant: Ford Global Technologies, LLC, Dearborn, MI (US)

(72) Inventor: Charles Michael Molnar, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 86 days.

(21) Appl. No.: 16/601,671

(22) Filed: Oct. 15, 2019

(65) Prior Publication Data

US 2020/0300020 A1 Sep. 24, 2020

Related U.S. Application Data

(60) Provisional application No. 62/822,396, filed on Mar. 22, 2019.

(51) Int. Cl.

| | |
|---|---|
| ***E05F 15/00*** | (2015.01) |
| ***E05F 15/603*** | (2015.01) |
| ***E05F 15/77*** | (2015.01) |
| *E05B 47/00* | (2006.01) |

(52) U.S. Cl.

CPC ..... *E05F 15/603* (2015.01); *E05F 15/77* (2015.01); *E05B 2047/0068* (2013.01); *E05Y 2400/31* (2013.01); *E05Y 2400/322* (2013.01); *E05Y 2400/40* (2013.01); *E05Y 2900/531* (2013.01)

(58) Field of Classification Search

CPC . E05F 15/77; E05F 15/70; E05F 15/42; E05F 15/74; E05F 15/603; E05F 15/78; E05F 15/40; E05F 15/73; E05F 15/616; E05Y 2400/322; E05Y 2400/31; E05Y 2400/40; E05Y 2900/531; E05Y 2400/44; E05Y 2400/326; E05B 2047/0068; B60J 5/047; G07C 5/34; G01D 5/14; G01D 5/145; G01D 5/342; G01D 5/165; G01D 5/24

USPC ..... 49/29, 30, 31, 41

See application file for complete search history.

(56) References Cited

U.S. PATENT DOCUMENTS

| | | | |
|---|---|---|---|
| 5,625,175 | A | 4/1997 | Gutknecht et al. |
| 7,039,494 | B2 | 5/2006 | Otsuki et al. |
| 7,690,156 | B2 | 4/2010 | Imai et al. |
| 7,919,940 | B2 | 4/2011 | Miller et al. |
| 8,450,337 | B2 | 3/2013 | Gebhart et al. |
| 10,030,431 | B2 | 7/2018 | Elie et al. |
| 2004/0225382 | A1 | 11/2004 | Brown et al. |

(Continued)

FOREIGN PATENT DOCUMENTS

DE 102016200411 A1 7/2017

OTHER PUBLICATIONS

Macfarlane et al., "Jerk-Bounded Manipulator Trajectory Planning: Design for Real-Time Application," IEEE Transactions on Robotics and Automation, vol. 19, No. 1, Feb. 2003 (11 pages).

(Continued)

*Primary Examiner* — Chi Q Nguyen

(74) *Attorney, Agent, or Firm* — David L. Coppiellie; Price Heneveld LLP

(57) ABSTRACT

A powered vehicle closure system includes a controller that is configured to control a force of a powered actuator to provide smooth opening and/or closing operations.

20 Claims, 10 Drawing Sheets

(56) References Cited

U.S. PATENT DOCUMENTS

| | | | | |
|---|---|---|---|---|
| 2015/0240548 | A1* | 8/2015 | Bendel | E05F 15/70 701/49 |
| 2016/0001781 | A1* | 1/2016 | Fung | B60K 28/02 701/36 |
| 2017/0030127 | A1* | 2/2017 | Elie | E05F 15/77 |
| 2017/0030134 | A1* | 2/2017 | Elie | E05F 15/71 |
| 2017/0030137 | A1 | 2/2017 | Elie et al. | |
| 2017/0030737 | A1* | 2/2017 | Elie | E05F 15/70 |
| 2017/0147927 | A1* | 5/2017 | Hwang | G01N 33/0063 |
| 2017/0247926 | A1* | 8/2017 | Elie | E05F 15/73 |
| 2017/0247933 | A1* | 8/2017 | Elie | G01K 3/005 |
| 2018/0106091 | A1* | 4/2018 | Smith | B60J 1/17 |
| 2020/0157873 | A1* | 5/2020 | Sabatini | B60Q 1/323 |
| 2020/0262270 | A1* | 8/2020 | Williams | E05F 15/71 |
| 2020/0270928 | A1* | 8/2020 | Cumbo | E05F 15/616 |
| 2020/0298790 | A1* | 9/2020 | Caron | B60Q 9/00 |

OTHER PUBLICATIONS

Alviar, "Jerk Limited Tracking Mode for Sofia Cavity Door Drive System," University of Wisconsin-Madison, 2011 (61 pages).

* cited by examiner

CLOSED LOOP DOOR POSITION CONTROL

CROSS-REFERENCE TO RELATED APPLICATION

This application claims the benefit under 35 U.S.C. § 119(e) to U.S. Provisional Patent Application No. 62/822,396, filed Mar. 22, 2019, entitled "CLOSED LOOP DOOR POSITION CONTROL," which is incorporated herein by reference in its entirety.

FIELD OF THE INVENTION

The present invention generally relates to a powered closure system for vehicles, and in particular to powered closure system that provides smooth opening and/or closing operations.

BACKGROUND OF THE INVENTION

Various powered door arrangements have been developed for motor vehicles. Known systems may include a pivotal door, a position sensor, and a powered device that pivots the door.

BRIEF SUMMARY OF THE INVENTION

One aspect of the present disclosure is a powered vehicle closure system including a vehicle body structure having an opening. A closure member such as a door, lift gate, lid, etc. is movably mounted to the body structure. The closure member may optionally comprise a door that is rotatably mounted to the vehicle body by a hinge structure, and the door may be configured to move between open and closed positions. The system includes a powered actuator such as an electrically powered motor that is configured to rotate the door relative to the body structure. The electrically powered motor may be configured to open the door relative to the body structure to provide access to the opening and/or to close the door relative to the body structure to close off access to the opening. The system may include a position sensor that is configured to provide a measured position of the closure member as the closure member moves relative to the body structure. The system further includes a controller that is configured to control a force of the electrically powered actuator to cause the closure member to move in a substantially smooth manner. The controller may, optionally, be configured to cause the closure member to move according to an S-shaped position vs time function such as a sinusoidal curve. The position vs time function is preferably a continuously differentiable function, and preferably has a smooth, continuous first derivative with respect to time (velocity), a smooth, continuous second derivative with respect to time (acceleration), and a smooth, continuous third derivative with respect to time (jerk).

Embodiments of the first aspect of the disclosure can include any one or a combination of the following features:

- The system may be configured to provide substantially jerkless operation whereby there are no changes in velocity exceeding about 0.01 radians per second.
- The sensor may optionally comprise an anisotropic magnetoresistive (AMR) sensor including first and second components that move (e.g. rotate) relative to one another as the door moves or rotates.
- The sensor may be configured to generate an absolute position signal.

- The system may optionally include a powered latch that is configured to selectively retain the closure member (e.g., door) in a closed position.
- The controller is optionally configured to unlatch the powered latch and cause the electrically powered motor to open the closure member when an activation switch is activated.

Another aspect of the present disclosure is a method of controlling movement of a vehicle door relative to a vehicle body structure. The method includes utilizing an angular position sensor to provide measured position data to a controller. The controller is configured to utilize measured position data to generate a signal to a powered actuator to move the door between open and closed positions in a substantially smooth manner by causing the door to follow a smooth position vs time function that is preferably continuously differentiable.

Embodiments of the second aspect of the disclosure can include any one or a combination of the following features:

- The method may, optionally, include utilizing a position vs time function that is sinusoidal.
- The controller may be configured to move the door in a jerkless manner.
- The controller may be configured such that the door does not have sudden changes in velocity exceeding about 0.01 radians per second.

Another aspect of the present disclosure is a powered vehicle door system including a body structure having an opening and a door that is rotatably mounted to the body structure by a connecting structure. The door system includes an electrically powered actuator that is configured to move the door relative to the body structure. The door system further includes an absolute position sensor that is configured to provide a measured position of the door as the door moves relative to the body structure. The system also includes a controller that is configured to utilize measured position to control a force of the electrically powered actuator to cause the door to move according to a smoothly curved position vs time function that is preferably continuously differentiable whereby the door moves from a starting position to an ending position in a continuous, smooth manner that is substantially jerkless.

Embodiments of the third aspect of the disclosure can include any one or a combination of the following features:

- The controller may be configured to move the door in a manner that avoids sudden changes in velocity exceeding about 0.01 radians per second.
- The position vs time function may be substantially sinusoidal.

These and other features, advantages, and objects of the present disclosure will be further understood and appreciated by those skilled in the art by reference to the following specification, claims, and appended drawings.

DETAILED DESCRIPTION

Figure 1:
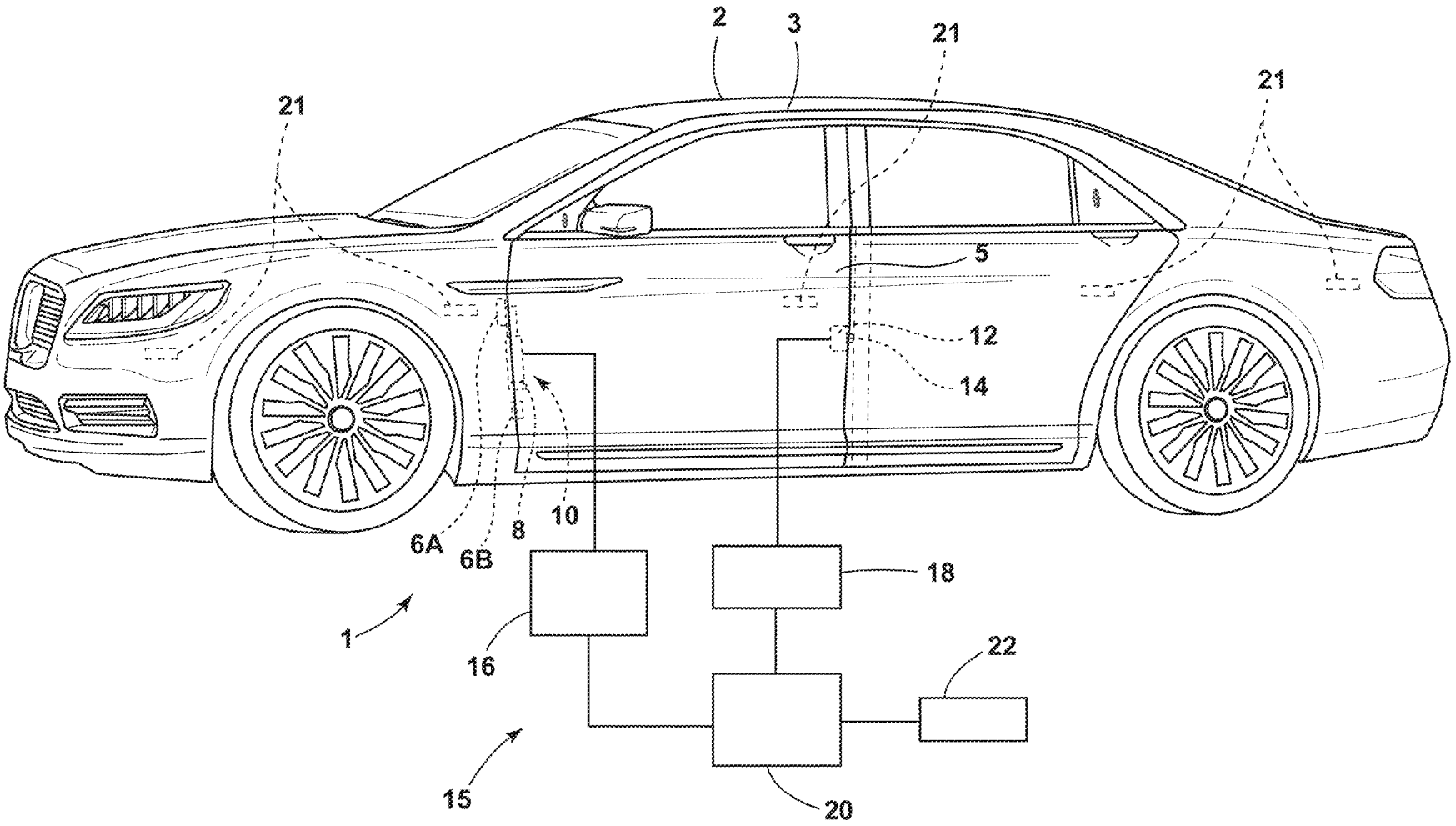
FIG. 1 is a fragmentary partially schematic side elevational view of a vehicle having a powered door according to one aspect of the present disclosure.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present application is related to U.S. patent application Ser. No. 14/812,249 filed on Jul. 29, 2015, entitled "AUTOMOTIVE DOOR POWER ASSIST," now U.S. Pat. No. 10,030,431, the entire contents of which are incorporated by reference.

Figure 2:
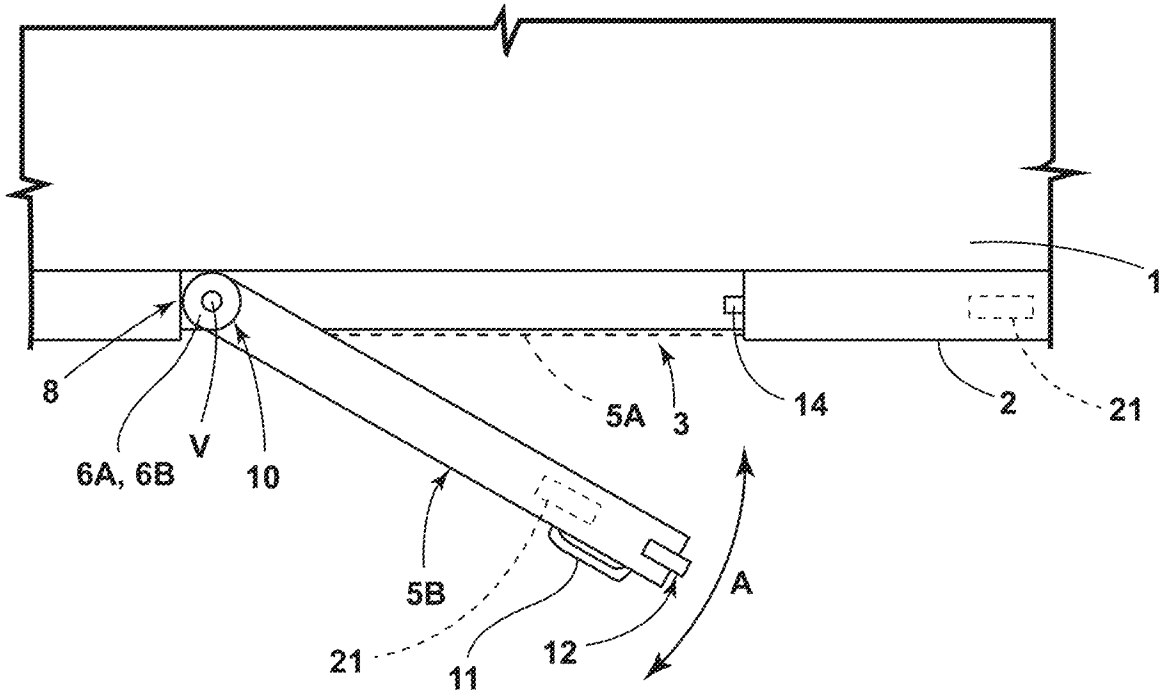
FIG. 2 is a fragmentary partially schematic top plan view of the powered door of FIG. 1.

With reference to FIGS. 1 and 2, a motor vehicle 1 according to one aspect of the present disclosure includes a body structure 2 having an opening 3. A closure member such as a door 5 is movably mounted to the body structure 3. Door 5 may be rotatably mounted to body structure 3 by a hinge structure such as hinges 6A and 6B for rotation about an upright axis "V." As discussed in more detail below, the vehicle 1 includes a door position sensor 8, a control system 15, and a powered actuator such as an electrically powered motor assembly 10 that may be actuated by control system 15 to move (e.g. rotate) the door 5 from a closed position 5A (FIG. 2) to an open position 5B (FIG. 2), and/or to return the door 5 to the closed position from an open position. The door 5 may include a powered latch 12 that selectively retains the door 5 in the closed position 5A. The powered latch 12 may be configured to selectively engage a striker 14 mounted to the vehicle structure 2. It will be understood that the powered latch 12 may be mounted to the vehicle body 2 and the striker 14 may be mounted to the door 5. Door 5 may optionally include an exterior handle 11 (FIG. 2). The vehicle door 5 described herein is merely an example of a closure member. However, the position sensor 8, powered actuator 10, and control system 15 may be utilized to open and/or close a wide range of vehicle closure members such as pivoting and/or sliding doors, lift gates, tail gates, lids, etc. Also, the control system 15 may be configured to control movement of multiple doors 5 and/or closure members of vehicle 1.

Referring again to FIG. 1, vehicle 1 includes a control system 15 that may include a door motor controller 16, a latch controller 18, and a main controller 20. The electrical components of vehicle 1 may be operably connected to an electric power system 22. It will be understood that the controllers 16, 18, and 20 of FIG. 1 are shown in schematic form, and the control system of the present disclosure may be implemented utilizing various microcontrollers, communication buses, and auxiliary power supplies as required for a particular application. Thus, it will be understood that the terms "controller" and "control system" as used herein, are not limited to any specific hardware and/or software configuration.

Figure 3:
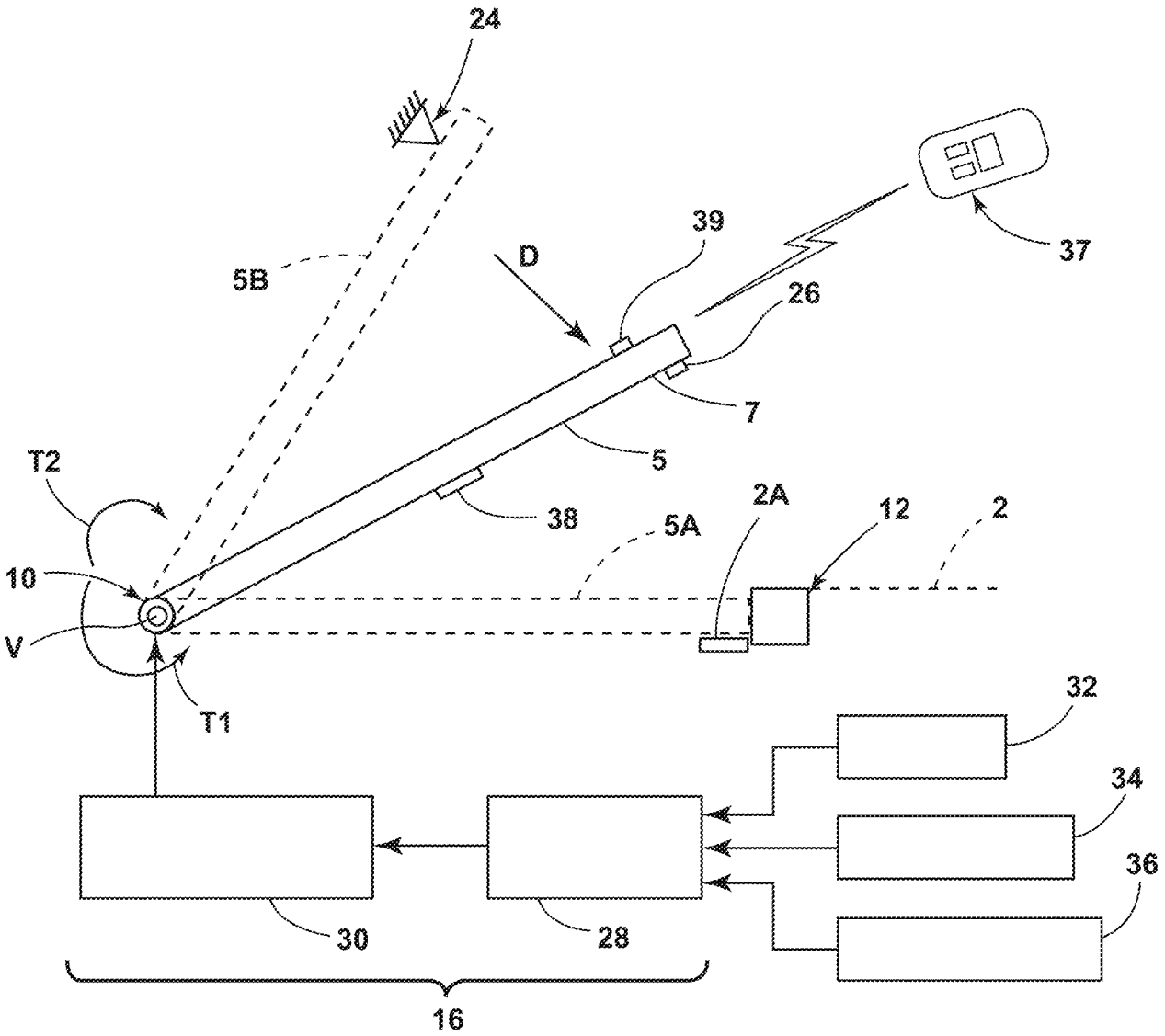
FIG. 3 is a schematic view of the door and motor control system.

With further reference to FIG. 3, when the door 5 (or other closure member) is in a fully open position 5B, the travel of the door may be limited by a hard stop 24. In FIG. 3, the hard stop 24 is shown schematically. Hard stop 24 may comprise rotational stops of hinge 6A and/or 6B or other suitable structure. Door stops are generally known in the art such that a detailed description is not believed to be required. When the door 5 reaches a fully closed position 5A, the rotation of the door 5 is limited by a stop which may comprise contact between door seals 26, surface 2A and vehicle body 2. Door seals 26 may comprise elongated resilient elastomeric members of a known type that extend around the opening 3 in vehicle body 2.

The door motor controller 16 may comprise a motor controller 28 and a motor driver 30. The motor controller 28 is configured to receive inputs from one or more sensors 32. Sensors 32 may include, for example, an optional door actuation switch 38 mounted on an interior side 7 of door 5 and/or an optional door actuation switch 39 disposed on an exterior side 9 of door 5. A wireless fob 37 may also be utilized to generate a door open command that is utilized as an input to the control system 15. The door actuation switches may comprise a proximity sensor or other switch that can be activated by a user inside vehicle 1. The switches 38 and 39 generate a "door open" signal to the controller 16 when actuated by a user. Controller 16 may be configured to unlatch the powered latch 12 and actuate the electrically powered motor 10 to open the door 5 when a signal is received from switch 38 or switch 39. Controller 16 may be configured to open door 5 (e.g. unlatch powered latch 12 and actuate the electrically powered motor 10) only if other predefined conditions exist. For example, control system 15 may be configured to open door 5 when exterior switch 39 is actuated only if an authorized user (e.g. wireless fob) is detected. Control system 15 may also be configured to open door 5 when interior switch 38 is actuated only if vehicle 1 is stationary or moving below a predefined maximum allowable speed (e.g. 3 mph).

As discussed in more detail below, sensor 8 may optionally comprise an absolute angular position sensor, such as an anisotropic magnetoresistive (AMR) sensor, a GMR sensor, a TMR sensor, an inductive absolute position sensor, or the like. Position sensor 8 is operably connected to a door motor controller 16 to provide angular position data of the vehicle door 5 relative to the vehicle body 2. Sensor 8 may comprise virtually any sensor (e.g., a Hall Effect sensor) that is capable of providing position data concerning the position of door 5 relative to body 2. Additional sensors may include, for example, sensors (e.g., switches) that indicate when the door 5 is in the fully open or fully closed position. Still further, the sensors 32 may include vehicle speed sensors and/or other sensors that provide the door controller 16 with data concerning various vehicle operating parameters.

The controller 16 may also optionally receive input from an automated vehicle (AV) control 34. More specifically, vehicle 1 may comprise an AV that is capable of automated operation. The vehicle controller 20 (FIG. 1) may include an AV controller 34 that utilizes data from various sensors (e.g., ultrasonic sensors 21) to detect objects that are adjacent to vehicle 1 and generate control signals to control vehicle operations. Inputs from the AV control 34 may be utilized by the door motor controller 16 to control operation of the vehicle door 5. For example, controller 16 may be configured to control opening and/or closing of door 5 in a manner that prevents contact between door 5 and pedestrians, pets, and moving or stationary objects. Sensors 21 may be capable of detecting objects in the path of door 5, and controller 16 may reverse electrically powered motor 10 to stop movement of door 5 to avoid hitting an object. Also, controller 16 may determine that door 5 has contacted an object if the electric current to electrically powered motor 10 increases while door 5 is stopped and/or not moving at an expected velocity for the electric current being drawn by electrically powered motor 10. Also, sensor 21 on door 5 may further comprise an accelerometer. If door 5 experiences sudden increases or decreases in velocity (i.e., acceleration), the system may determine that an external force (e.g., due to wind, or object, etc.) has been applied to door 5 tending to open or close door 5, or tending to prevent opening or closing of door 5. As discussed in more detail below in connection with FIGS. 7, 7A, and 7B, the system may be configured to account for such disturbances and resume smooth door opening/closing operation. Furthermore, the door motor controller 16 may also receive human inputs 36.

Motor controller 28 and motor driver 30 may be configured to provide control of the electrically powered actuator/motor 10 to cause the electrically powered motor 10 to generate a variable torque "T1" to open and/or close the door 5. Friction, inertia, and/or other conditions may cause a torque "T2" that must be overcome by the motor torque T1 to open or close the vehicle door 5. It will be understood that some external forces (e.g. wind) may assist opening of door 5, and the controller may be configured to generate reduced torque or braking torque if required. As discussed in more detail below, the door motor controller 16 may be configured to provide a control signal causing the door 5 to open at a velocity that may vary as a function of the position of the vehicle door 5 relative to the vehicle body 2. This may involve providing a variable torque T1 providing a door rotation rate that is a function of the angular position of the vehicle door 5 and follows a desired angular rate as closely as possible.

Figure 4:
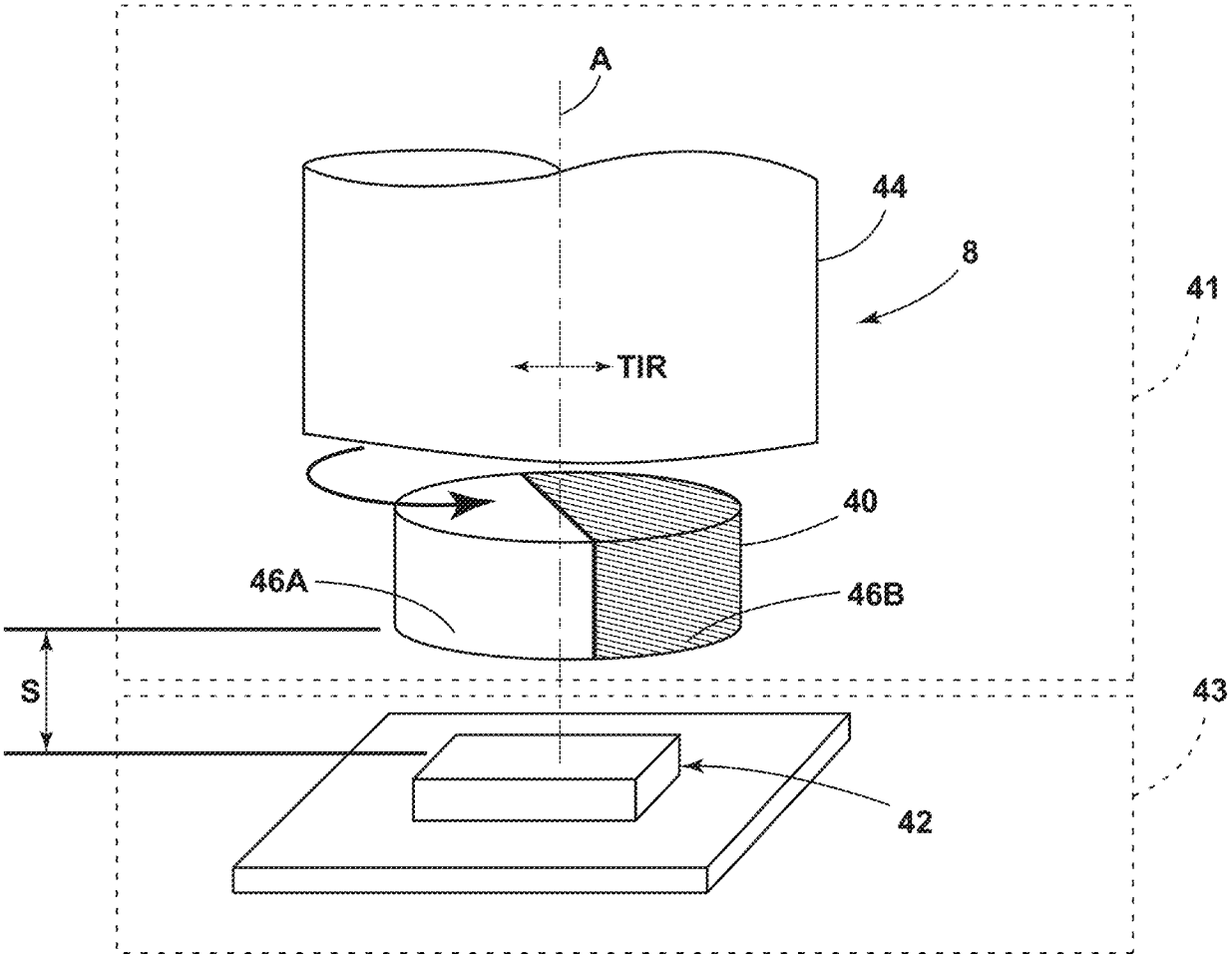
FIG. 4 is a partially schematic isometric view of an AMR sensor.

With reference to FIG. 4, sensor 8 may, optionally, comprise an AMR sensor that includes first and second components 40 and 42 that rotate relative to one another about an axis "A." Axis A of FIG. 4 may be coaxial with upright axis V (FIGS. 2 and 3). The first component 40 may comprise a disk magnet that is mounted to a first structure 41 that rotates relative to a second structure 43. The magnet 40 defines poles 46A and 46B, and the second component 42 comprises an AMR sensor that senses an angular position of the first component 40 relative to the second component 42 based on the angular position of poles 46A, 46B. The AMR sensor 8 may comprise an anisotropic magnetoresistive sensor, a giant magnetoresistive (GMR) sensor, or a tunnel magnetoresistive (TMR) sensor. As used herein, the term "AMR sensor" refers to virtually any sensor that is capable of sensing an absolute position. In general, AMR sensors are capable of generating absolute angular position signals in mechatronic rotational and linear systems for closed loop angular position control of vehicle enclosures such as doors. Thus, compared to conventional encoders, the AMR sensor 8 provides a signal to the door motor controller 16 indicating the absolute position of the vehicle door 5 relative to the vehicle body 2, without requiring a rotary encoder or the like. However, position sensor 8 may optionally comprise a position sensor that does not provide an absolute position (e.g., a sensor that includes a rotary encoder). As noted above, the AMR sensor 8, powered actuator, and control system may be utilized to control opening and/or closing of virtually any enclosure including, in addition to doors, lift gates, tail gates, lids, etc.

Magnet 40 may be fixed to a shaft 44 (FIG. 4) that rotates relative to a non-moving (stationary) second structure 43. The shaft 44 may comprise a shaft of an electric motor, a shaft of a door hinge 6A or 6B, or other component. It will be understood that the magnet 40 and AMR sensor 42 may be switched such that the magnet 40 is mounted to a fixed or non-moving structure 43, and the AMR sensor component 42 is mounted to a moving structure 41 (e.g. shaft 44). The magnet 40 and AMR sensor 42 are spaced apart a distance "S." The distance "S" is preferably maintained within a predefined tolerance. Similarly, angular misalignment between magnet 40 and AMR sensor 42 is also preferably maintained within a predefined allowable tolerance. As discussed below, the control system 15 may be calibrated at the time vehicle 1 is assembled to account for variations in the relative angular position of components 40 and 42.

Figure 5:
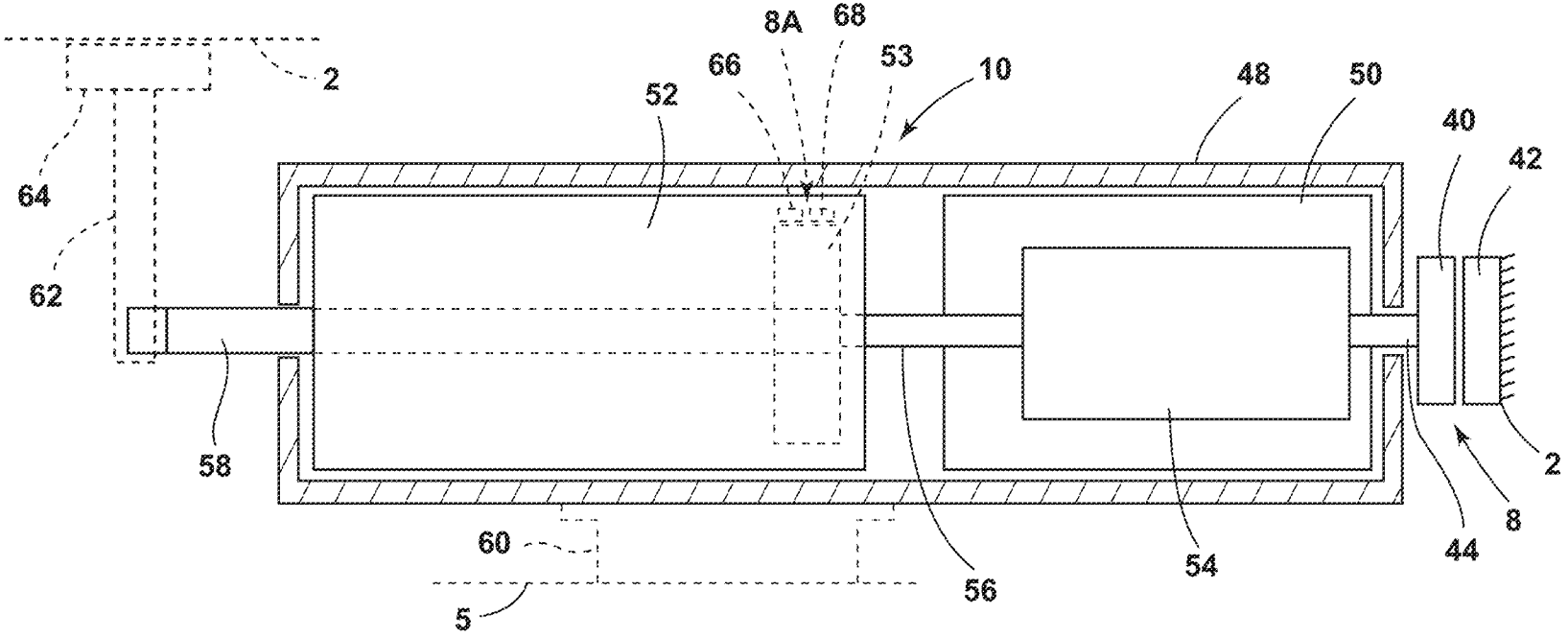
FIG. 5 is a partially schematic cross-sectional view of an electric motor, gear box, and AMR sensor.

With further reference to FIG. 5, the electrically powered motor assembly 10 may include a housing 48, an electric motor 50, and (optional) gear drive 52 that are disposed within the housing 48. A rotating internal component 54 (rotor) of electric motor 50 drives a shaft 56 as an input to the gear drive 52. The gear drive 52 provides powered rotation of output shaft 58. The gear drive 52 may comprise a suitable reduction gearing system (e.g. planetary gear drive) such that output shaft 52 is driven at a lower RPM than the motor output shaft 56 with increased torque. The housing 48 may be rigidly mounted to the door structure 5 by a bracket 60, such that the housing 48 moves with the door 5. Output shaft 58 may be operably connected to the vehicle body structure 2 by a linkage such as an arm 62 and bracket structure 64. Actuation of electric motor 50 causes rotation of shaft 58 which, in turn, causes door 5 to rotate relative to the body structure 2. Various linkage arrangements may be utilized to operably interconnect to moving components (e.g. door 5) to the stationary component (e.g. body 2) and the present disclosure is not limited to the arrangement of FIG. 5. Also, it will be understood that various powered actuators (e.g., rotary or linear AC electric motors, rotary or linear DC electric motors, hydraulic or pneumatic actuators, etc.) may be utilized as required for a particular application. It will be understood that the electric motor 2 may be fixed to the body structure 2 by a suitable bracket arrangement, and the arm 62 and bracket 64 may, in turn, be secured to the vehicle door structure 5.

The position sensor 8 (FIG. 5) may optionally comprise an absolute position AMR sensor including a first component (e.g. a magnet 40) that is mounted to an output shaft 44 of electric motor 50, and the AMR sensor component 42 may be mounted to the vehicle body structure 2. Rotation of the electric motor 50 causes rotation of the magnet 40 relative to the AMR sensor component 42, thereby providing an angular position measurement or signal to the door motor controller 16. Door motor controller 16 may be configured to account for the gear ratio of the gear drive 52 whereby an accurate absolute angular position of the vehicle door 5 relative to the vehicle body structure 2 is utilized in the door control. It will be understood that FIG. 5 is schematic in nature, and represents one example of a possible configuration for the electrically powered motor assembly 10 and position sensor 8. In general, components 40, 42 of position sensor 8 may be mounted to any two portions of two components that move relative to one another in operation to thereby provide an absolute angular position of the two components relative to one another to the controller 16.

If position sensor 8 comprises an AMR sensor, the components 40 and 42 may be fixed to suitable door and body components at the time the vehicle 1 is assembled, and the controller 16 may be calibrated to account for variations in the positions of the components 40 and 42 relative to one another that may occur at the time of assembly. For example, the positions of components 40 and 42 relative to one another may vary due to production tolerances and the like. The door 5 may be moved to a fully closed position, and the controller 16 may be programmed to recognize this position as the fully closed position of the door. In this way, production tolerances and the like can be accounted for at the time the vehicle 1 is assembled. The control system 15 may also be configured to periodically calibrate the position of the door 5 after assembly. For example, system 15 may be configured to detect that the door 5 is in a fully closed position if powered latch is actuated and/or if other sensors indicate that the door 5 is in a fully closed position. The controller system 15 may periodically reset the fully closed position of door 5 to account for variations that may occur during use of the vehicle 1.

Position sensor 8 may comprise virtually any suitable sensor. Suitable AMR position sensors may include digital output signals such as (a) an SPI bus—an absolute angular position encoded as digital number, or (b) an I2C bus—an absolute angular position encoded as digital number, or (c) a PWM—an absolute angular position encoded as a quasi-digital number encoded as a percentage of duty cycle of a square wave. The AMR sensor may provide an analog output signal such as (a) a quadrature—two analog voltages whose encoded phase indicates absolute position, or (b) a single analog voltage that is proportional to the absolute angular position, or (c) a Vernier configuration—two analog channels using gears in a radial configuration. As noted above, the position sensor 8 may optionally comprise (1) an anisotropic magnetoresistive sensor, or (2) a giant magnetoresistive sensor, or (3) a tunnel magnetoresistive sensor.

If an axial mounting configuration is utilized wherein the sensors are at an end of a shaft, on axis, the sensors and magnets are preferably positioned on opposite sides of a moving mechanism. The electronics may be located (e.g., mounted) on the stationary side, and the magnet may be located (e.g., mounted) on the moving side. The position sensor 8 may utilize a diametrically poled disk magnet, and the sensors may be mechanically aligned to the axis of rotation for minimum TIR (<0.5 mm), angular alignment (<2°), and clearance offset (~1 mm). The magnets may be aligned to the same degree as the sensors to the rotational axis, and the magnets may be mechanically or adhesively retained. The sensor components 40 and/or 42 may be disposed in a waterproof enclosure, and may be operably connected to the control system 15 utilizing waterproof electrical connectors.

Referring again to FIG. 5, the gear drive 52 may include a gear 53 that rotates with shaft 56. An alternative position sensor 8A may comprise first and second radially-mounted AMR sensors 66 and 68 that provide for absolute angular position measurement. The AMR sensors 66 and 68 have gear teeth differing by one count to create a Vernier angle measuring system. The AMR sensor 8A may be configured to utilize analog output AMR sensors 66 and 68.

Figure 6:
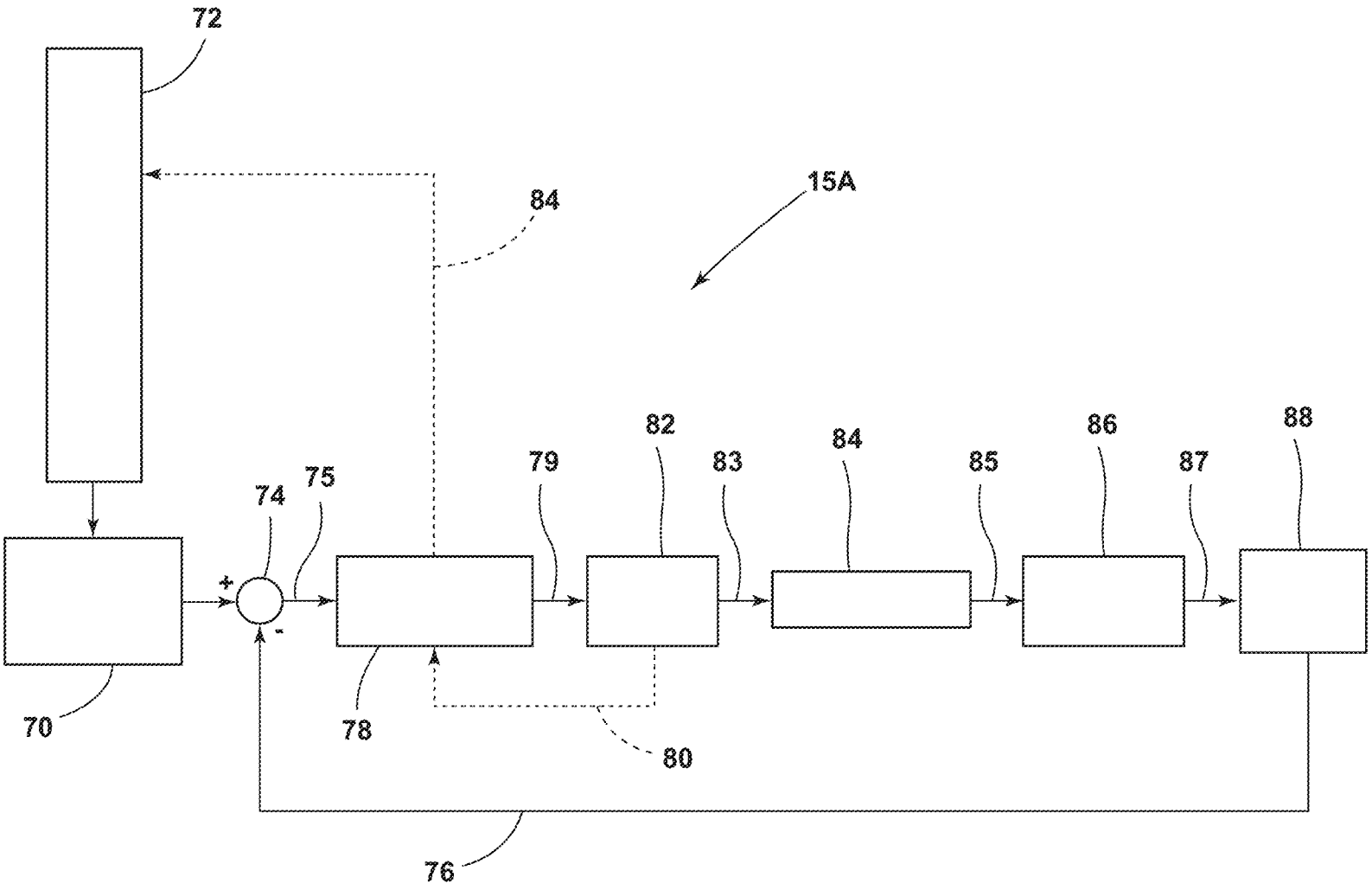
FIG. 6 is a schematic view of a controller according to one aspect of the present disclosure.

Controller 15 may be configured as shown in FIGS. 6-9. With reference to FIG. 6, door motor controller 15A may include a motor position command 70 that receives higher priority level door logic 72 that commands the motor to move to a desired position, stop, and compensate for disturbances. A position summing junction 74 receives commands from the motor position command 70, and also receives door position data 76 from door position sensor 88. It will be understood that the door position sensor 88 may comprise an AMR sensor 8 or other suitable sensor. The junction 74 provides door position error 75 to a motor controller 78. The motor controller 78 provides low power commands 79 to motor driver 82, and motor driver 82 provides overcurrent feedback 80 to the motor controller 78. Overcurrent feedback 84 may also be utilized by the system to determine the higher priority level door logic control 72.

The motor controller 78 provides low powered motor commands 79 to motor driver 82, and the motor driver 82 provides high powered motor commands 83 to a powered actuator such as a gear motor 84. Gear motor 84 may comprise an electrically powered assembly such as the assembly 10 of FIG. 5, and may include an electric motor and gear drive. The gear motor 84 provides mechanical hinge motion and position 85 to door assembly 86, and the door position 87 relative to the vehicle body is sensed by the door position sensor 88. It will be understood that door assembly 86 may be substantially similar to door 5 described above.

The motion (angular position) of door 5 may be expressed as follows:

Door Angular Position=$\theta(t)=A\sin(2\pi ft+\varnothing)+B=A\sin(\omega t+\varnothing)+B$ Where t=time A=an amplitude $2\pi f=\omega$=radian frequency =phase angle B=an offset (B may be necessary to avoid negative door angles in some systems having reference frames that cannot be negative). A fully latched door has a door angle of 0 radians.

In general, $\Omega\neq\omega$

Figure 7:
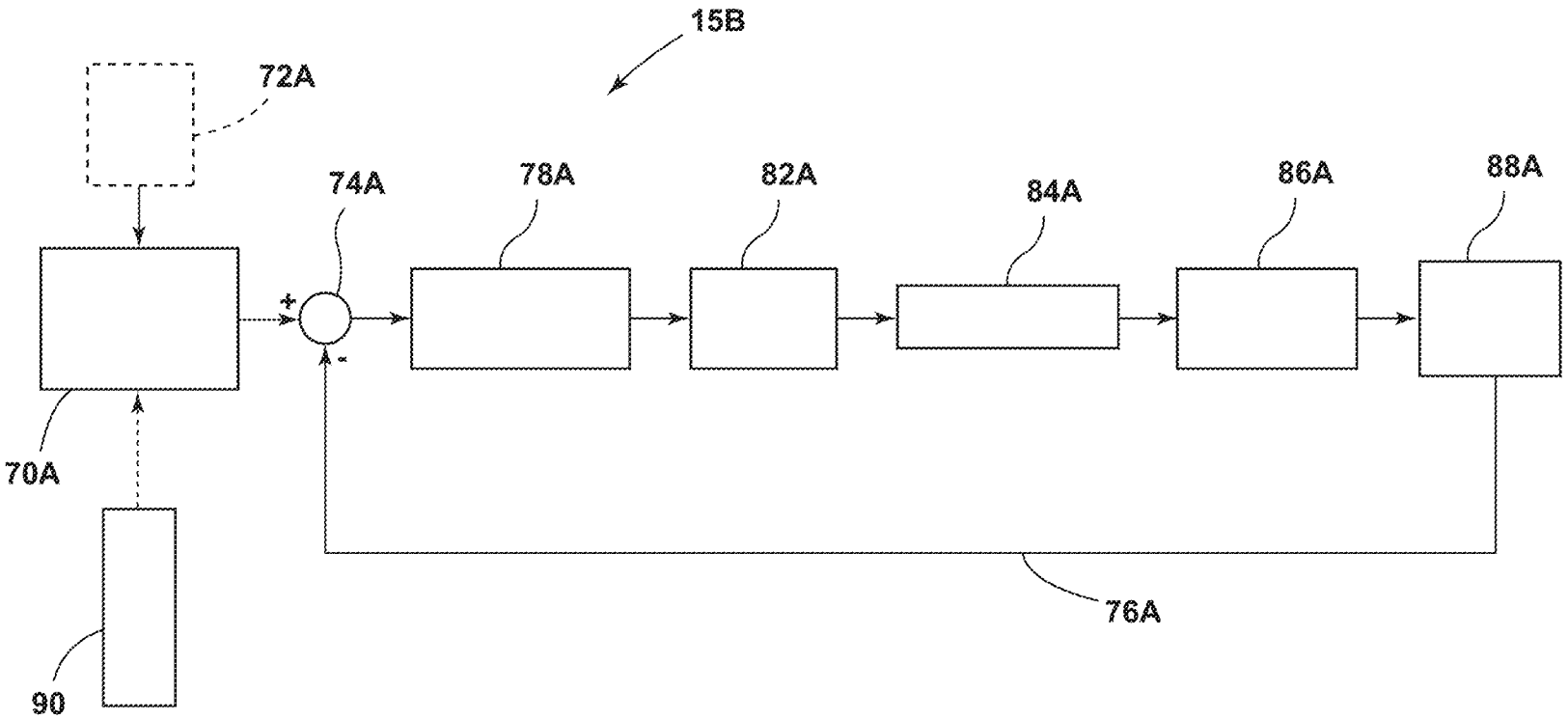
FIG. 7 is a schematic view of a controller according to another aspect of the present disclosure.
Figure 7B:
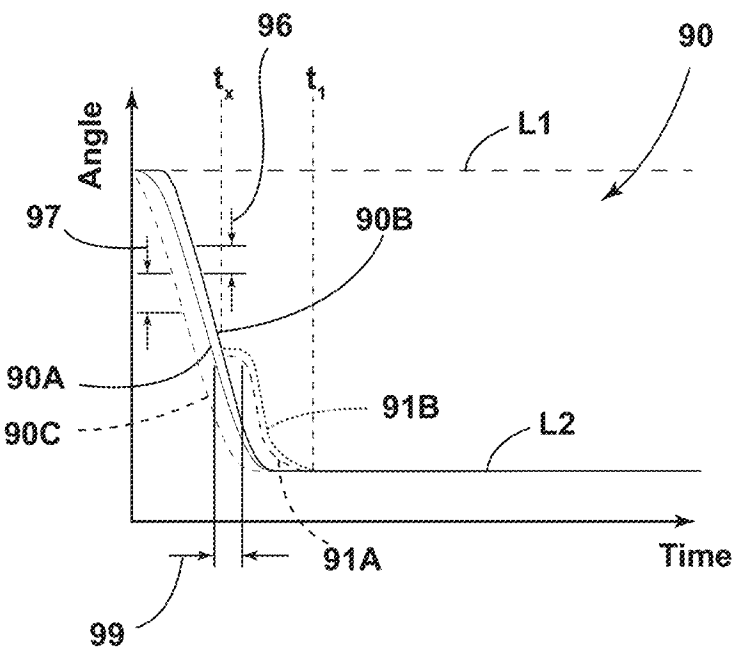
FIG. 7B is a graph showing commanded door position and actual (measured) door position over time as a door is closed.
Figure 7A:
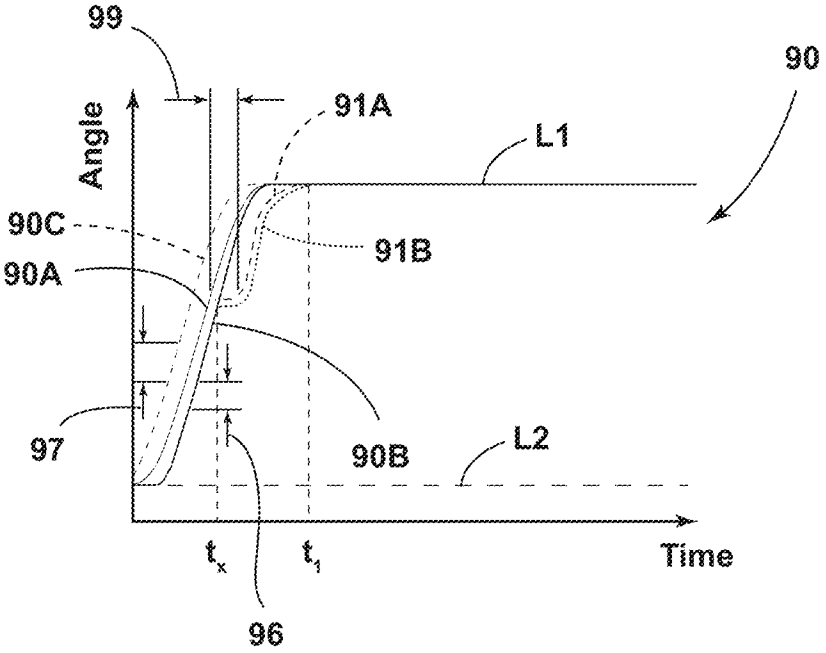
FIG. 7A is a graph showing commanded door position and actual (measured) door position over time as a door is opened.

It follows that:

Angular Velocity=$\Omega(t)=\dot{\theta}(t)=A\,\omega\cos(\omega t+\varnothing)$ Angular Acceleration=$\alpha(t)=\ddot{\theta}(t)=-A\,\omega^2\sin(\omega t+\varnothing)$ Jerk1=$\dddot{\theta}(t)=-A\,\omega^3\cos(\omega t+\varnothing)$ With further reference to FIG. 7, a control system 15B may include motor position command 70A, motor controller 78A, motor driver 82A, gear motor 84A, door assembly 86A, and door position sensor 88A that provides door position data 76A to the position summing junction 74A. The system 15B is substantially similar to the system 15A of FIG. 6, and represents a baseline motor controller 78A. The motor position command 70A includes inputs 90 which may comprise S-curves as shown in FIGS. 7A (door opening) and 7B (door closing). The range of motion of door 5 when opening may be limited by a mechanical stop of hinges 6A, 6B, or a door strap (not shown). When door 5 is closing, the range of motion is mechanically limited by contact between door 5 and body 2 and/or latch 12. Horizontal line segments L1 (FIG. 7A) and L2 (FIG. 7B) generally correspond to the mechanical stops during opening and closing, respectively.

With further reference to FIG. 7A, during door opening operation, the S-curves 90 may comprise command (desired) door positions 90A and actual door positions 90B and 90C. The S-curves 90A, 90B may comprise a door angular position as a function of time. The command (desired) door positions 90A generally include starting and ending portions that are horizontal or approximately horizontal such that the position of door 5 as a function of time changes more gradually at the start and end of the door path (motion). The system 15B may be configured to utilize an S-curve 90A having start and end angles that are equal to the mechanical stops (e.g., lines L1 and L2), or S-curve 90A may have end points that are either before or after the mechanical stops. In particular, the commanded S-curve 90A may have end points that are 0.5-1.0 degrees less than the mechanical stops. Line 90B represents measured door positions (e.g., angles) that are less than a commanded position at each time, and line 90C represents measured door positions that are greater than a commanded door position 90A.

It will be understood that the measured door positions 90B and 90C are merely examples of possible measured door positions. These examples are provided to aid in explaining the concepts described herein, but the present disclosure is not limited to these examples. The measured door positions may have shapes that are significantly different than the lines 90B and 90C. For example, if a force such as an object of a gust of wind acts on the door 5, the measured door position may be significantly greater or less than the commanded position for a period of time (or the measured position 90B or 90C may cross command line 90A) until the controller generates an increased or decreased torque commands to the electrically-powered motor assembly 10 sufficient to bring the measured position back to the commanded position line 90A. In the event of a large input force (e.g., if door 5 contacts an object), rather than returning the measured door position (e.g., line 90B) back to the original command line 90A, the controller may (optionally) be configured to shift the command line. For example, if the door 5 encounters a large force at time $t_x$ (FIG. 7A) that stops door 5 or significantly slows the rate at which the door 5 is opening, the controller may shift the remaining portion of the command line 90A by a time difference 99 to create a new command line segment 91A, and differences between line segment 91A and measured door position 91B may be utilized to control door position until the door is fully open. New command line segment 91A may optionally comprise an S-curve (e.g., sinusoidal curve) having a shape that is substantially similar to commanded position line 90A but extending over the reduced angular distance of the remaining door path segment. Similarly, if a brief force tending to rapidly open door 5 causes the angle to increase very rapidly for a period of time, the controller may (optionally) be configured to "shift" to a new command curve (not shown) that is above and left of the original command line 90A in FIG. 7A. Thus, input 90 may comprise desired door positions 90A. The S-curves 90A and 90B are preferably continuously differentiable functions such as sine or cosine curves (i.e., the S-curves are preferably sinusoidal). Thus, the curves 90A and 90B are preferably continuously differentiable to the nth degree.

The control system 15 may be configured to rapidly and continuously measure the angular position of the door 5 at very small time intervals (e.g., 10 times per second, 100 times per second, 1,000 times per second). Control system 15 may comprise a PID controller that utilizes differences in position and/or the derivative and/or the integral of position with respect to time. At each measurement time "t" the controller 15 may determine a difference 96 between the commanded position (line 90A) and the measured position (lines 90B and 90C). The difference 96 may be utilized as an input to determine a torque signal (e.g., electrical current) to the actuator (electrical powered motor assembly 10). In general, during opening operations (FIG. 7A), the controller may be configured to increase torque of actuator 10 if the measured position at a time t is greater than the command position (line 90BA). The integral (sum of differences in position) and derivative of position may also be utilized by control system 15 to determine torque control required to follow the command line segment 90A.

Door closing operations (FIG. 7B) may also utilize S-curves 90A, 90B, 90C, etc. in substantially the same manner as the door opening operations described above in connection with FIG. 7A. However, as shown in FIG. 7B, during door closing operations, the S-curves have a negative slope due to the decreasing angular position over time. Also, it will be understood that FIG. 7A may describe door closing operations if the starting angle of FIG. 7A is the door open position, and the door position (angle) is considered to be increasing as the door opens (i.e. the position/angle of FIG. 7A may comprise an angle relative to a starting angle at which the door 5 is either open or closed). Although the S-curve control during door closing operations (FIG. 7B) may be substantially similar to the S-curve control during door opening operations (e.g., the S-curves for both door opening and closing operations may be sinusoidal curves and the opening time may be equal to the closing time), the door opening and closing operations are not necessarily identical. For example, the total opening and closing command times could be different (e.g., the controller 15 may be configured to open door 5 more slowly than the door 5 is closed). Similarly, controller 15 may be configured to utilize S-curve command lines having different shapes for door opening and closing operations.

The door 5 preferably moves in a substantially smooth, jerkless manner whereby the door 5 does not have sudden changes of velocity exceeding 0.01 radians per second. The criteria for jerkless movement may comprise larger or smaller quantities (e.g. 0.005 radians per second, 0.001 (or less) radians per second, 0.5 radians per second, 1.0 (or greater) radians per second, etc. as required for a particular application. Also, to achieve smooth motion, constraints are placed on the velocity of the door 5 at the start point and end point of the motion profile. Specifically, the angular velocity preferably has zero slope (or close to zero slope) at the start and end point of door travel.

The slope of the lines 90A and 90B represent the desired (command) and actual velocities of the door 5 as it opens or closes. Thus, the controller may be configured to cause the door 5 to travel along a S-curve (i.e. move at a desired velocity) based on sensor feedback 76A and/or other factors. The baseline controller 78 comprises a linear, time invariant causal system. The system may utilize a State Space control system including door system kinetic parameters. However, other control systems may also be utilized. The door position controller may be digital or analog, and virtually any suitable position controller may be used (e.g. PID, feed forward, fuzzy logic). The door position controller may be configured to conform to applicable hardware and software standards (e.g. AEC-Q100, ISO26262, AUTOSAR, etc.). The door opening/closing position commands may be S-curves 90A, 90B, etc. conforming to a predefined kinematic specification to provide for smooth door motion. For example, the S-curve 90A may comprise sinusoidal or non-sinusoidal curves that include regions with lower slope (velocity) during initial and final motion of door 5. In particular, S-curve 90A may be sinusoidal or approximately sinusoidal.

The motor position commands may be derived from higher priority processes that incorporate automated vehicle (AV) state flow controller commands.

Figure 8:
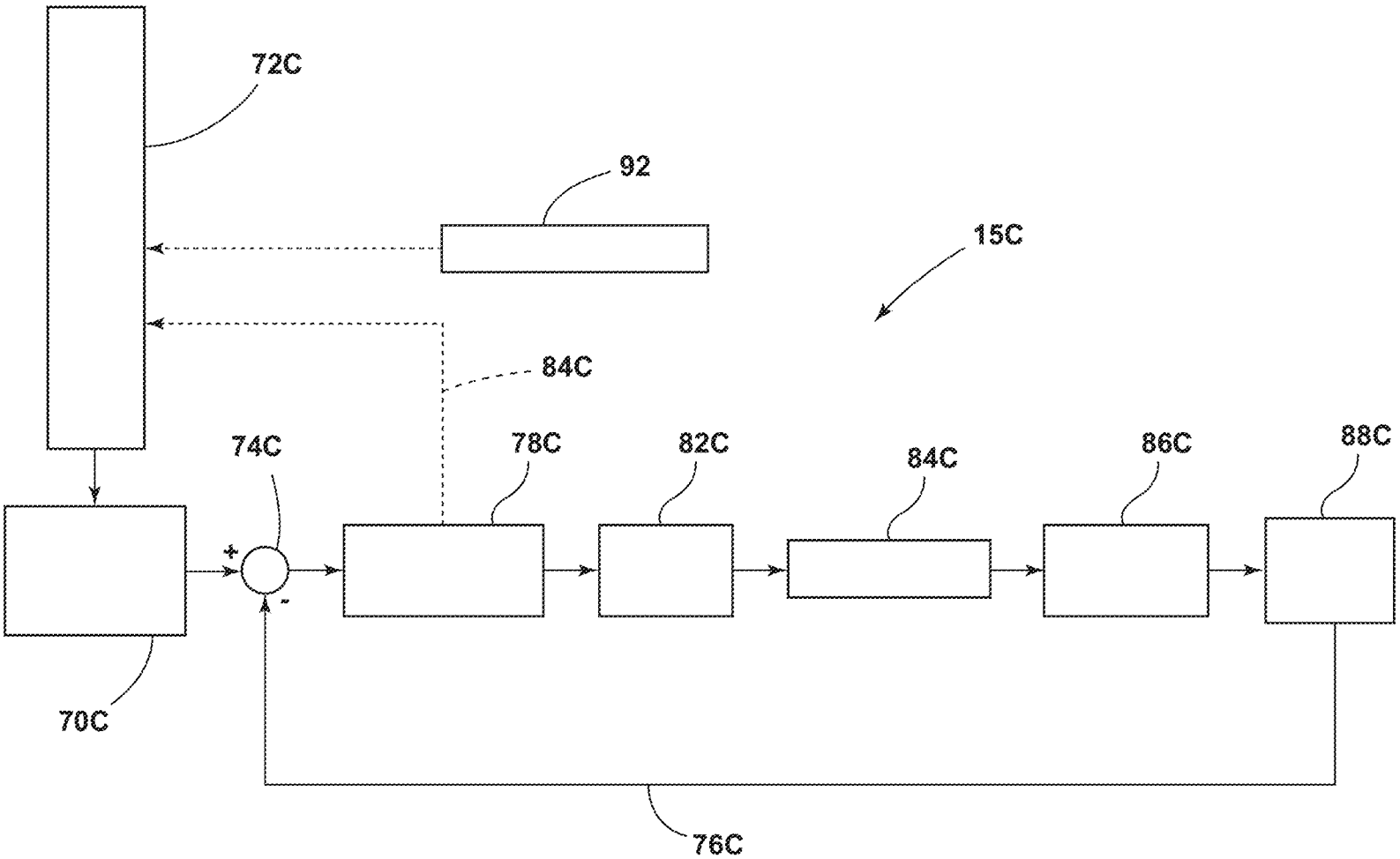
FIG. 8 is a schematic view of a controller according to another aspect of the present disclosure.

With further reference to FIG. 8, control system 15C is similar to the control systems 15A and 15B described above in connection with FIGS. 6 and 7. The system 15C further includes accelerometer 92 that provides acceleration data to the higher priority door logic 72C. The system 15C is an adaptive motor control system. More specifically, the system 15C is a linear adaptive control system in which some controller coefficients and states are altered due to contact sensors. Adaptive controls may take into account disturbances such as wind gusts, uneven (i.e. not level) road surfaces, roll, pitch, and human forces (e.g. pushes) on the door 5. System 15C utilizes accelerometer inputs 92 that may be provided by a controller ECU to thereby account for roll, pitch, and external forces.

Figure 9:
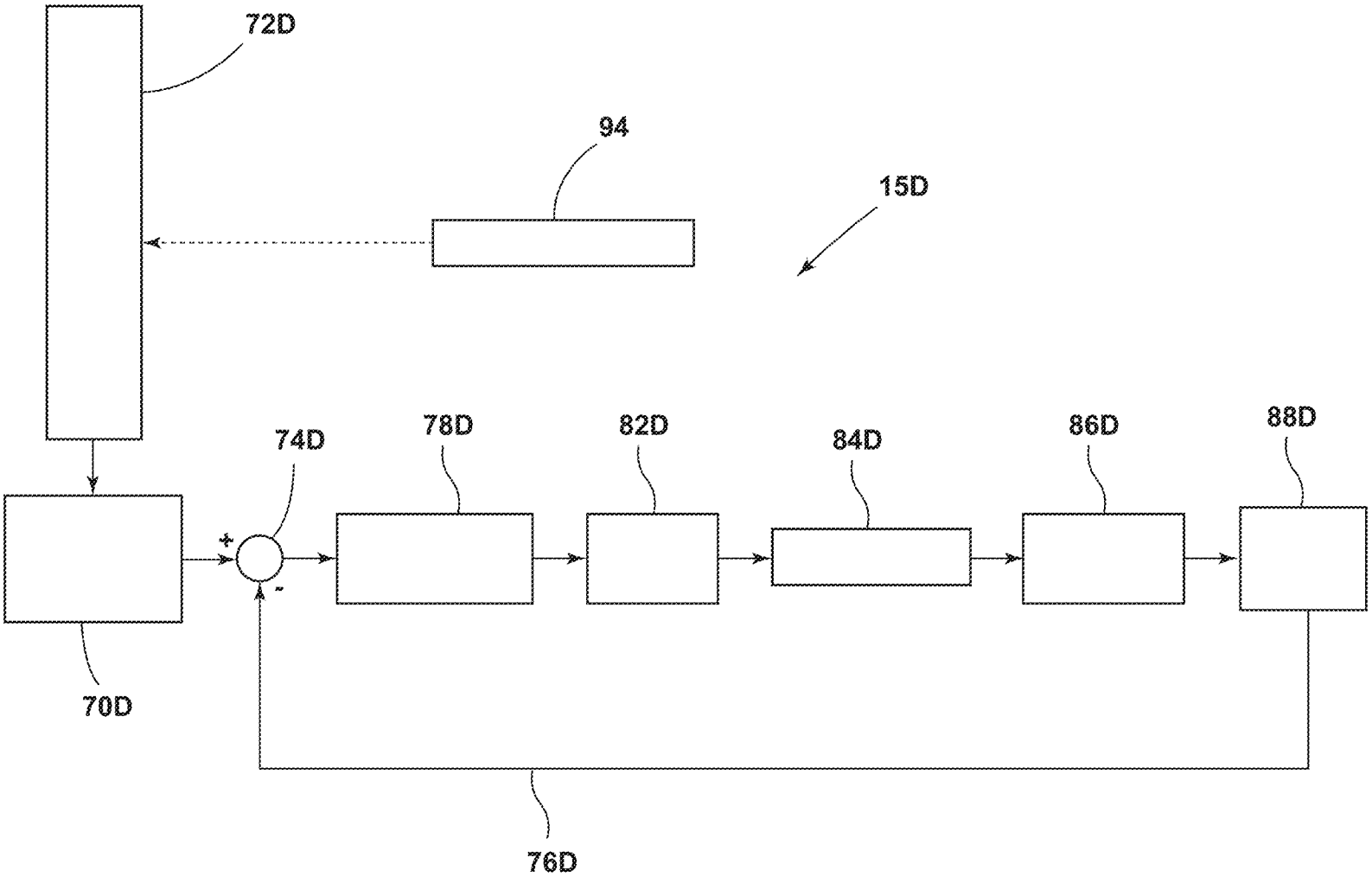
FIG. 9 is a schematic view of a controller according to another aspect of the present disclosure.

With further reference to FIG. 9, a control system 15D utilizes inputs from object detection sensors 94. The object detection sensors 94 may, for example, detect pedestrians or other objects adjacent to the vehicle door 5. The system 15D may comprise a predictive motor control system. More specifically, system 15D may comprise a linear, time-varying, non-causal (i.e. predictive) control system in which some controller coefficients and states are altered due to non-contact object detection sensors. The system may be configured to anticipate contact with curbs, posts, pedestrians, etc., and stop door movement in open and/or closed direction while the door is moving, or to prevent further movement if the door 5 is stationary at the time an object is detected.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A powered vehicle closure system comprising:

a body structure having an opening;

a closure member movably mounted to the body structure by a connecting structure for movement between a closed position and an open position;

an electrically powered actuator configured to move the closure member relative to the body structure;

a position sensor configured to provide a measured position of the closure member as the closure member moves relative to the body structure; and a controller configured to utilize measured position to control a force of the electrically powered actuator to cause the closure member to move according to an S-shaped position vs time function having starting and ending positions whereby a velocity of the closure member smoothly transitions from a first minimum at a starting position to a maximum at a central position between the starting and ending positions, and to a second minimum at the ending position.

2. The powered vehicle closure system of claim 1, wherein:

the S-shaped position vs time function corresponds to an S-shaped commanded door position function;

and wherein the controller is configured to minimize differences between the S-shaped position vs time function and the S-shaped commanded door position function.

3. The powered vehicle closure system of claim 2, wherein:

the S-shaped commanded door position function is substantially sinusoidal.

4. The powered vehicle closure system of claim 2, wherein:

the controller is configured to utilize an S-shaped position vs time function during door opening and closing operations.

5. The powered vehicle closure system of claim 1, wherein:

the first and second minimums comprise zero velocity.

6. The powered vehicle closure system of claim 1, wherein:

a derivative of the S-shaped position vs time function is S-shaped.

7. The powered vehicle closure system of claim 1, wherein:

the controller comprises a Proportional-integral-Derivative (PID) controller.

8. The powered vehicle closure system of claim 1, wherein:

the electrically powered actuator comprises an electric motor having a drive shaft; and the position sensor comprises an absolute position sensor having first and second components that generate absolute position signals as the first and second components move relative to one another, and wherein the first component of the absolute position sensor is mounted to the drive shaft.

9. The powered vehicle closure system of claim 8, wherein:

the absolute position sensor comprises an Anisotropic Magneto-Resistive (AMR) sensor.

10. The powered vehicle closure system of claim 1, including:

an activation switch;

a powered latch configured to selectively retain the closure ember in a closed position; and wherein:

the controller is configured to unlatch the powered latch and cause the electrically powered actuator to open the closure member when the activation switch is actuated.

11. The powered vehicle closure system of claim 1, wherein:

the closure member comprises a door that is rotatably connected to the body structure by a hinge structure for rotation about a vertical axis.

12. The powered vehicle closure system of claim 1, wherein:

the controller is configured to move the door in a jerkless, smooth manner such that a third derivative of the position vs time function is substantially zero.

13. The powered vehicle closure system of claim 1, wherein:

the S-shaped position vs time function is continuously differentiable.

14. A method of controlling movement of a vehicle door relative to a vehicle body structure, the method comprising:

utilizing an angular position sensor to provide measured position data to a controller; and configuring the controller to utilize the measured position data to generate a signal to a powered actuator to move the door between open and closed positions in a substantially smooth manner by causing the door to follow a position vs time function that is continuously differentiable such that a third derivative of the position vs time function is substantially zero.

15. The method of claim 14, wherein:

the position vs time function is sinusoidal.

16. The method of claim 14, wherein:

the position vs time function is non-sinusoidal.

17. The method of claim 14, including:

configuring the controller to move the door such that the door does not have sudden changes in velocity exceeding about 0.01 radians per second.

18. A powered vehicle door system comprising:

a body structure having an opening;

a door rotatably mounted to the body structure by a connecting structure;

an electrically powered actuator configured to move the door relative to the body structure;

an absolute position sensor configured to provide a measured position of the door as the door moves relative to the body structure; and a controller configured to utilize measured position to control a force of the electrically powered actuator to cause the door to move according to a position vs time function that is continuously differentiable whereby the door moves from a starting position to an ending position in a continuous, manner that is substantially jerkless such that a third derivative of the position vs time function is substantially zero.

19. The powered vehicle door system of claim 18, wherein:

the controller moves the door in a manner that prevents changes in velocity exceeding about 0.01 radians per second.

20. The powered vehicle door system of claim 19, wherein:

the position vs time function is substantially sinusoidal.

* * * * *